US005692054A

United States Patent [19]

Parrella et al.

[11] Patent Number: 5,692,054

[45] Date of Patent: Nov. 25, 1997

[54] MULTIPLE SOURCE SELF NOISE CANCELLATION

[75] Inventors: Michael J. Parrella, Weston, Conn.; Dexter G. Smith, Columbia, Md.

[73] Assignee: Noise Cancellation Technologies, Inc., Linthicum, Md.

[21] Appl. No.: 411,785

[22] PCT Filed: Oct. 8, 1992

[86] PCT No.: PCT/US92/08400

§ 371 Date: Jun. 30, 1995

§ 102(e) Date: Jun. 30, 1995

[87] PCT Pub. No.: WO94/09483

PCT Pub. Date: Apr. 28, 1994

[51] Int. Cl.[6] ..... G10K 11/16

[52] U.S. Cl. ..... 381/71; 415/119

[58] Field of Search ..... 381/71, 94; 415/119

[56] References Cited

U.S. PATENT DOCUMENTS 4,947,356 8/1990 Elliott et al. .
5,146,505 9/1992 Pfaff et al. .

FOREIGN PATENT DOCUMENTS

WO 91/12608 8/1991 WIPO .

*Primary Examiner*—Forester W. Isen

[57] ABSTRACT

A repetitive noise cancellation system for multiple noise sources employing a controller (36) which senses radiated noise by reference sensors (35) and the status of the noise sources by position sensors (37, 38) and automatically controls one of the noise sources so that the noises being emitted from the multiple sources cancel one another.

28 Claims, 4 Drawing Sheets

FIG.1
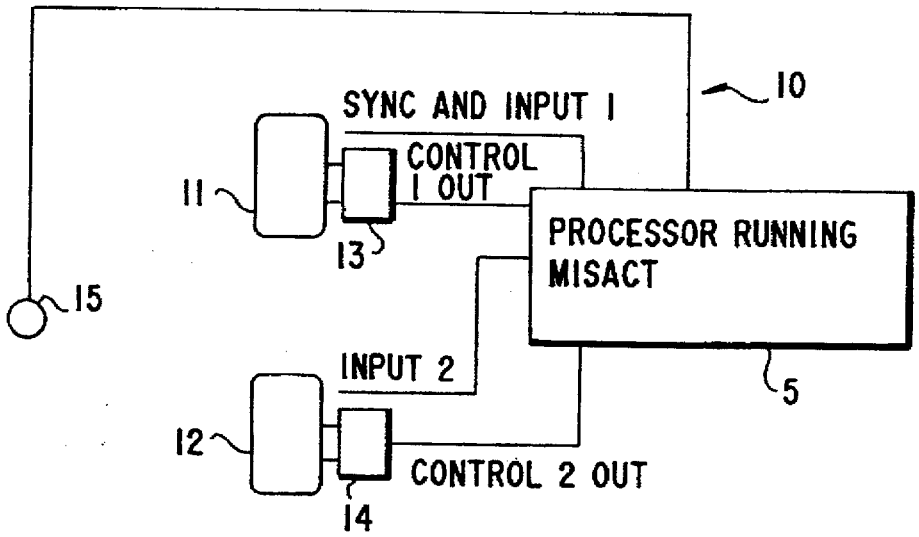
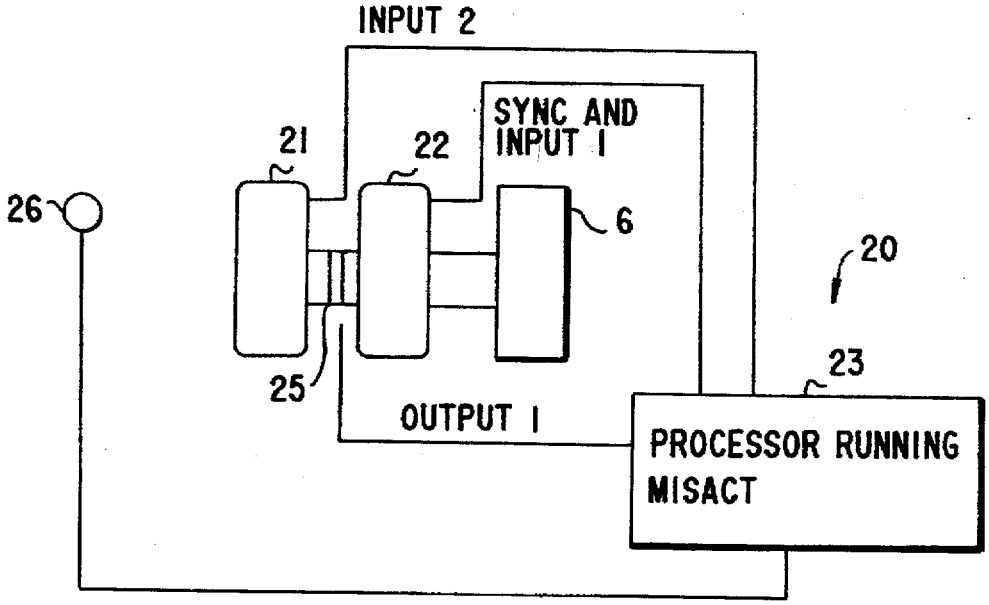
FIG.2

MULTIPLE SOURCE SELF NOISE CANCELLATION

This invention relates to a unique method of canceling noise or vibration where two or more noisy sources are employed. The tonal noise or vibration is canceled without the use of a loudspeaker or other transducer.

BACKGROUND AND SUMMARY OF THE INVENTION

The present invention refers to a method of canceling tonal noise (or vibration) generated by sources such as fans when installed into an appropriate apparatus to produce air flow. These fans usually have backward curved or backward inclined blades on the actual fan wheel. The wheel is installed into a housing with a certain scroll associated with it. Part of the scroll is a cutoff where the air flow is directed out the outlet of the housing. As the blades pass the cutoff, pressure pulses associated with them strike the cutoff and produce a tonal frequency equal to the rotational frequency times the number of blades on the wheel. Typical installations might create tonals from 50 to 2000 Hz. At these frequencies, passive silencing is not feasible due to the large amount of material necessary for these low frequencies. Therefore, active noise cancellation can be used.

In U.S. Pat. No. 5,091,953, hereby incorporated by reference herein, a repetitive phenomena canceling controller is described. The fundamental phenomenon frequencies are determined and a known electrical frequency corresponding to the fundamental and its harmonics is generated. A plurality of sensors and actuators is used to perform the canceling function with interactions between sensors and actuators taken into account by the controller. The algorithm will henceforth be referred to as MISACT.

The present invention employs some of the teachings of the MISACT algorithm. It includes the use of two or more rotating, tonal noise generating devices in conjunction with MISACT to cancel the tonal noise produced. The MISACT algorithm generates a control signal to synchronize the devices thereby minimizing the tonal noise at a specific location such as a fan inlet, outlet or both.

The invention includes methods to adjust the relative phase of noise producing pressure pulses. This can include multiple motors with single fan wheels or single motors with multiple fan wheels, for example. This can also include two or more motors mounted on a single plate.

The procedure in both systems is, given a certain motor or engine speed, to adjust the relative times at which the pressure pulses generate the noise so that at the error sensor the tonal noise is minimized. The great advantage to this approach is that no acoustic actuator such as a speaker or electromagnetic current is needed. The life of the canceling system will be as long at the motor and will not be limited by the speaker cone life.

Accordingly, it is an object of this invention to provide a unique method of canceling tonal noise generated by fans or other co-located rotating machinery.

Another object of this invention is to provide a method and device for canceling tonal noise in a system having a single fan on each multiple motor.

A further object of this invention is to provide a method and device for canceling tonal noise in a system having a single motor and multiple fans.

A still further object of this invention is to provide a method of canceling tonal noise in a system with multiple fans by adjusting the phase angle between the fans.

Another object of this invention is to provide a tonal noise canceling system without the use of an acoustic actuator.

Another object of this invention is to provide tonal vibration cancellation by adjusting the relative rotation between two co-located rotating machines without the use of an electromagnetic actuator.

These and other objects of the invention will become apparent when reference is had to the accompanying drawings in which FIG. 1 is a diagrammatic view of a two motor, two fan system, FIG. 2 is a diagrammatic view of a one motor, two fan system, FIG. 3 is a semi-diagrammatic view of self cancellation using two fans as sources, and FIGS. 4 and 5 show the effect on tonal noise when running with dual tonal fan phase control off and on, respectively.

DETAILED DESCRIPTION

Figure 3:
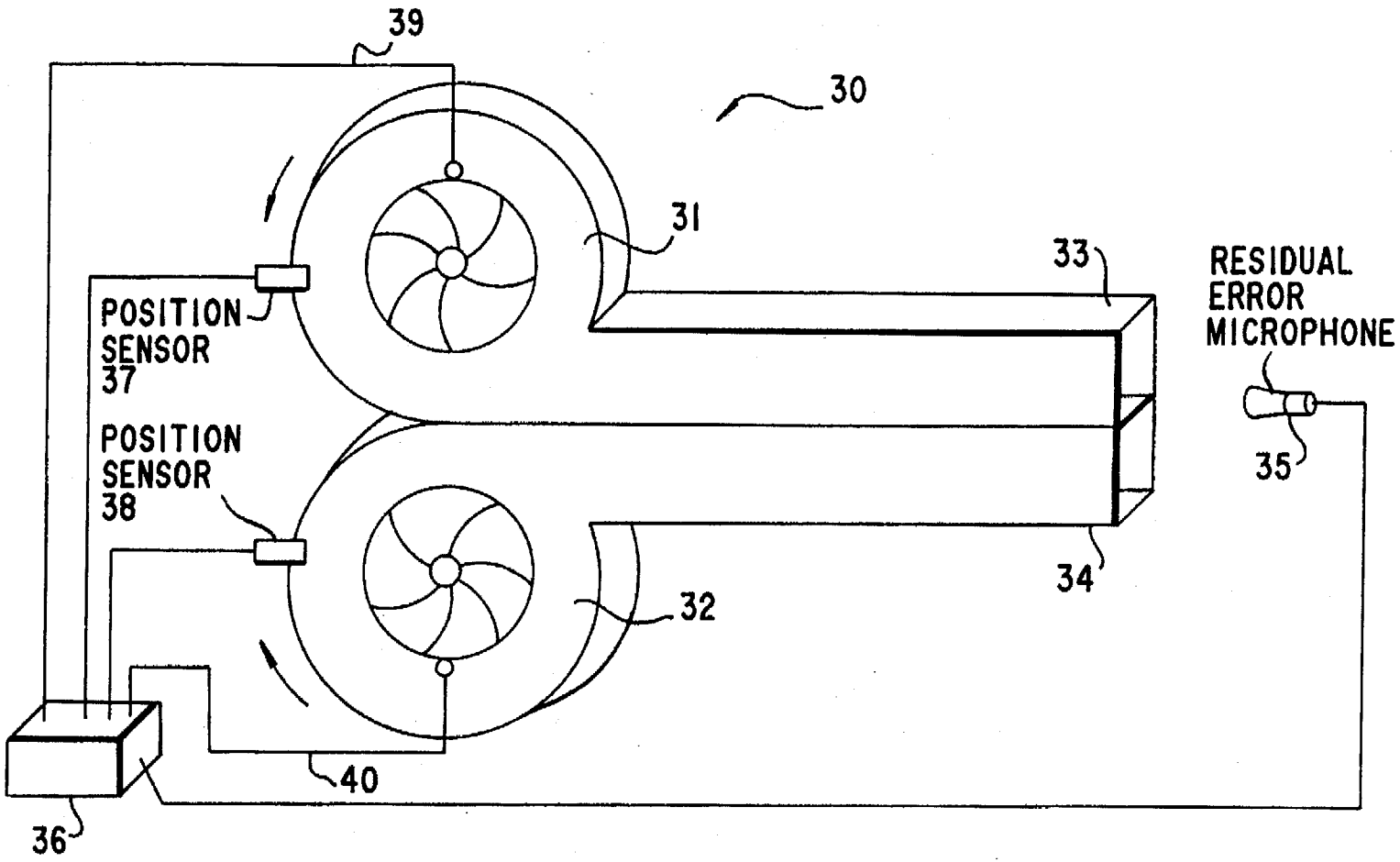

FIG. 1 depicts a two motor/two fan system 10. The blades or fans 11, 12 can be rotating in the same direction or counter rotating. It is assumed that they are installed into a housing where the passage of the blades creates tonal noise. One motor 13 is chosen as the reference with its rotation rate being the basic sync signal for the system The sync will also serve as input 1 to the MISACT system. Input 2 is another position signal that will be used by the MISACT algorithm processor 15 as a measure of the relative position of blade 12 versus blade 11. MISACT will keep the blades rotating at the same angular frequency but will adjust the relative times that the blades in each wheel go past the cutoffs in the housing. Thus, by adjusting that timing, MISACT will reduce the acoustic noise sensed at the error sensor 15. The synchronizing signal can be magnetic, optical or acoustic in nature and the sensor signal can be inductive or capacitive.

FIG. 2 is another two bladed system 20 but with both blades 21, 22 on the same shaft of motor 24. Here, the speed is set by the back pressure in the system and the timing of blades past the cutoff is adjusted to minimize the error sensor signal. The processor 23 is connected to error sensor 26. The phase is shifted at relative blade angle shifter 25 to minimize the signal from sensor 26.

FIG. 3 shows the detailed interaction from a system 30 such as that shown in. FIG. 1. Two fan motor and wheel combinations 31, 32 are mounted back to back with their outlets 33, 34 coming together at the error residual microphone 35. The controller 36 monitors the position of the blades of the wheels from position sensors 37, 38. Based on information from the error residual microphone 35, the controller adjusts the relative positions of the wheels by regulating motor speed through connections 39, 40 to reduce the tonal noise seen at the error residual microphone.

Figure 4:
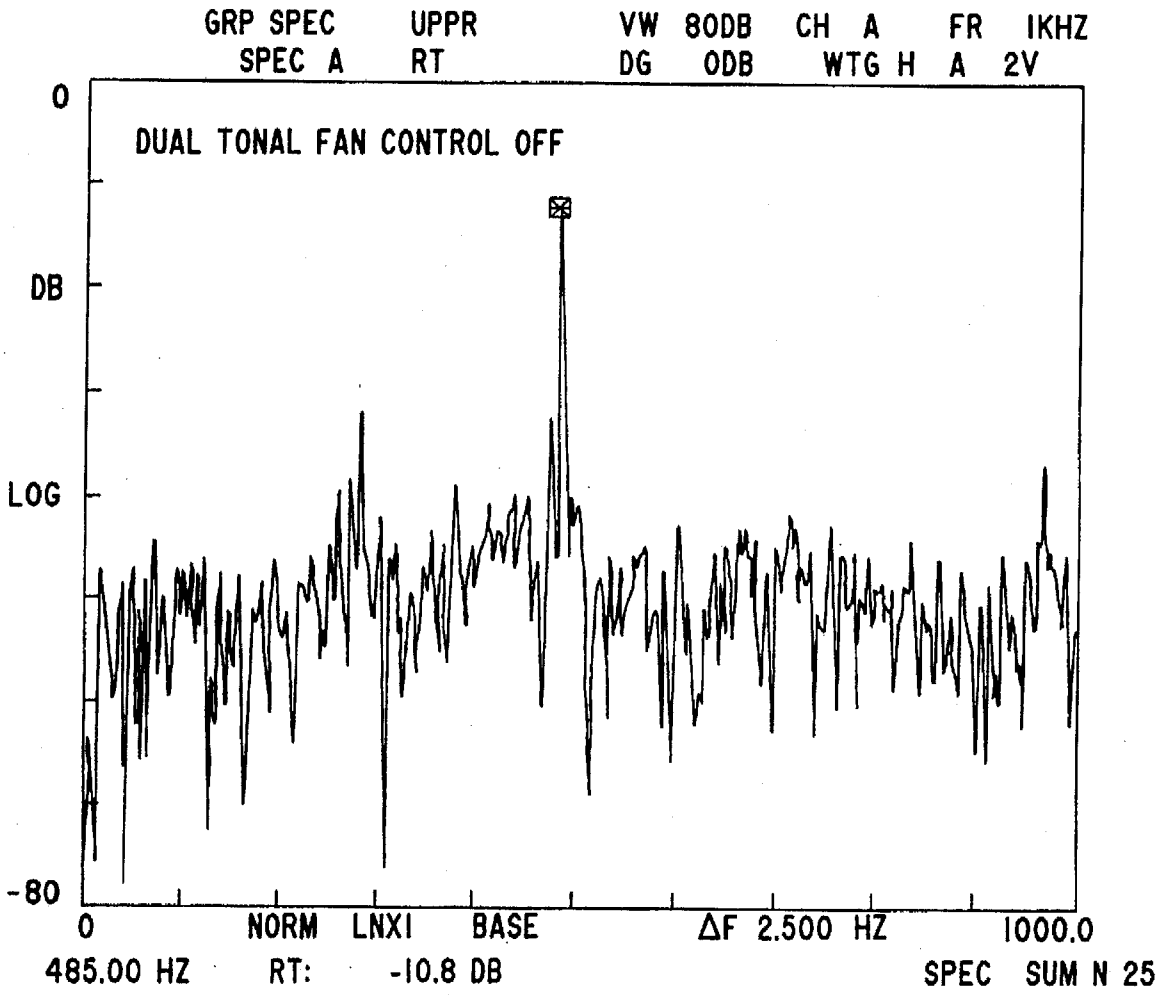
Figure 5:
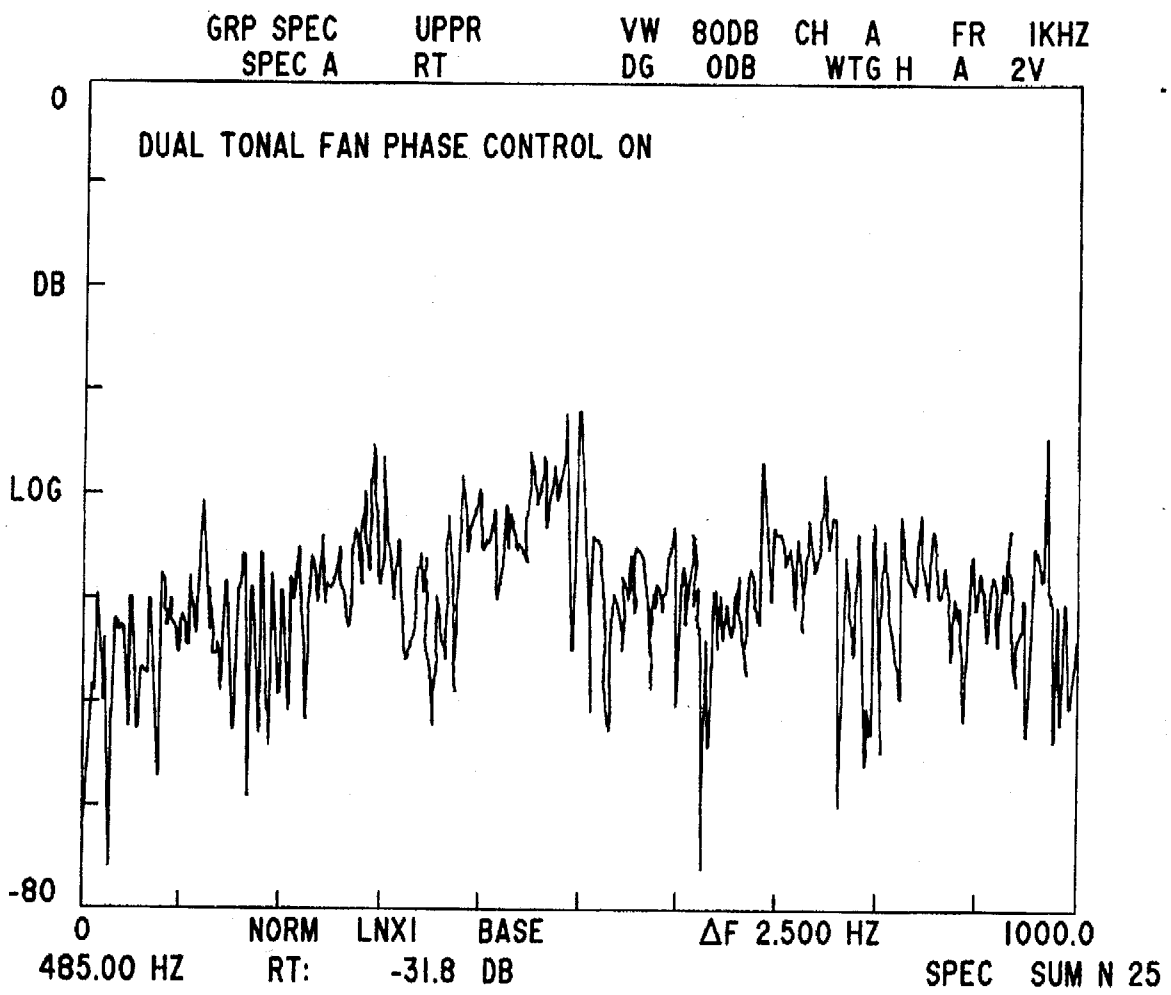

FIG. 4 shows the plot of a laboratory experiment using the apparatus in FIG. 3. The blade passage tonal is seen to be 485 Hz. The positions of the wheels were then adjusted to produce the results shown in FIG. 5. The blade passage tonal is seen to be reduced by 20 dB.

Thus it is seen that undesirable noise and/or vibration can be canceled without the use of a transducer/loudspeaker or counter vibrating means where there are multiple sources of said undesirable noise.

We claim:

1. A repetitive phenomena canceling controller system for canceling unwanted repetitive phenomena generated by co-located rotating devices comprising known frequency determining means for generating a known electrical frequency signal corresponding to the known fundamental frequencies of the unwanted repetition phenomena generated by the co-located rotating devices, a means for determining the relative timing of the generation of the fundamental unwanted phenomena using said known electrical frequency signal as a synchronizing signal, a single residual sensor for sensing and generating an electrical signal related to the residual unwanted noise, a plurality of actuators for providing canceling phenomena signals at a plurality of locations, controller means for automatically controlling each of the actuators as a function of the fundamental phenomena and the residual sensors while accommodating the interaction between various sensors and actuators.

2. A system as in claim 1 wherein including at least one means for generating said unwanted repetition phenomena.

3. A repetitive phenomena canceling controller system as claimed in claim 1, wherein said unwanted repetitive phenomena is generated by one main device with two or more unwanted, repetitive noise generating means attached.

4. A repetitive phenomena canceling controller system as claimed in claim 3, wherein said unwanted repetitive phenomena is generated by rotating blades.

5. A repetitive phenomena canceling controller system as claimed in claim 3, wherein said unwanted repetitive phenomena is generated by propellers.

6. A repetitive phenomena canceling controller system as claimed in claim 1, wherein said synchronizing signal is magnetic or inductive in nature.

7. A controller system as claimed in claim 6 wherein said unwanted repetitive phenomena is generated by rotating machinery.

8. A repetitive phenomena canceling controller system as claimed in claim 1, wherein said synchronizing signal is optical in nature.

9. A repetitive phenomena canceling controller system as claimed in claim 1, wherein said synchronizing signal is acoustic in nature.

10. A repetitive phenomena canceling controller system as claimed in claim 1, wherein said synchronizing signal is a means that operates at the rate of the unwanted phenomena.

11. A repetitive phenomena canceling controller system as claimed in claim 1, wherein said sensor signal is inductive or capacitive in nature.

12. A repetitive phenomena canceling controller system as claimed in claim 1, wherein said control signal is appropriate to control the speed of the main repetitive unwanted noise generating devices.

13. A repetitive phenomena canceling controller system as claimed in claim 1, wherein said control signal is appropriate to control the relative timing of the generation of the repetitive unwanted noise from two or more noise generating means on one main device.

14. A repetitive phenomena canceling controller system as claimed in claim 13 wherein said unwanted repetitive phenomena is generated from two or more noise generating means on two or more main devices.

15. A repetitive phenomena canceling controller system for canceling unwanted repetitive phenomena generated by co-located rotating devices comprising known frequency determining means for generating a known electrical frequency signal corresponding to the known fundamental frequencies of the unwanted repetition phenomena, wherein the unwanted repetition phenomena is generated by an air-moving device having two or more co-located rotating devices, a means for determining the relative timing of the generation of the fundamental unwanted phenomena using said known electrical frequency signal as a synchronizing signal, a single residual sensor for sensing and generating an electrical signal related to the residual unwanted noise, a plurality of actuators for providing canceling phenomena signals at a plurality of locations, controller means for automatically controlling each of the actuators as a function of the fundamental phenomena and the residual sensors while accommodating the interaction between various sensors and actuators.

16. A system as in claim 15 wherein including at least one means for generating said unwanted repetition phenomena.

17. A repetitive phenomena canceling controller system as claimed in claim 15, wherein said unwanted repetitive phenomena is generated by rotating blades.

18. A repetitive phenomena canceling controller system as claimed in claim 15, wherein said air-moving device is a fan.

19. A repetitive phenomena canceling controller system as claimed in claim 15, wherein said two or more co-located rotating devices are fans.

20. A repetitive phenomena canceling controller system as claimed in claim 15, wherein said synchronizing signal is magnetic or inductive in nature.

21. A controller system as claimed in claim 20 wherein said unwanted repetitive phenomena is generated by rotating machinery.

22. A repetitive phenomena canceling controller system as claimed in claim 15, wherein said synchronizing signal is optical in nature.

23. A repetitive phenomena canceling controller system as claimed in claim 15, wherein said synchronizing signal is acoustic in nature.

24. A repetitive phenomena canceling controller system as claimed in claim 15, wherein said synchronizing signal is a means that operates at the rate of the unwanted phenomena.

25. A repetitive phenomena canceling controller system as claimed in claim 15, wherein said sensor signal is inductive or capacitive in nature.

26. A repetitive phenomena canceling controller system as claimed in claim 15, wherein said control signal is appropriate to control the speed of the main repetitive unwanted noise generating devices.

27. A repetitive phenomena canceling controller system as claimed in claim 15, wherein said control signal is appropriate to control the relative timing of the generation of the repetitive unwanted noise from two or more noise generating means on one main device.

28. A repetitive phenomena canceling controller system as claimed in claim 27, wherein said unwanted repetitive phenomena is generated from two or more noise generating means on two or more main devices.

* * * * *